US006506086B2

(12) United States Patent
Matsumoto

(10) Patent No.: US 6,506,086 B2
(45) Date of Patent: Jan. 14, 2003

(54) EXHAUST SYSTEM FOR WATERCRAFT

(75) Inventor: Chihiro Matsumoto, Shizuoka (JP)

(73) Assignee: Sanshin Kogyo Kabushiki Kaisha, Hamamtsu (JP)

( * ) Notice: Subject to any disclaimer, the term of this patent is extended or adjusted under 35 U.S.C. 154(b) by 0 days.

(21) Appl. No.: 09/896,830

(22) Filed: Jun. 28, 2001

(65) Prior Publication Data

US 2002/0094731 A1 Jul. 18, 2002

(30) Foreign Application Priority Data

Jun. 28, 2000 (JP) ..... 2000-194276

(51) Int. Cl.[7] ..... B63H 21/32
(52) U.S. Cl. ..... 440/89
(58) Field of Search ..... 440/88, 89; 181/212, 181/264, 266, 272, 273, 276

(56) References Cited

U.S. PATENT DOCUMENTS 4,177,875 A * 12/1979 Kurobe et al. ..... 181/265
4,773,883 A 9/1988 Nakase et al.
4,811,560 A 3/1989 Nakase et al.
4,989,409 A 2/1991 Nakase et al.
4,997,399 A 3/1991 Nakayasu et al.
5,067,448 A 11/1991 Nakase et al.
5,096,446 A 3/1992 Tazaki et al.
5,183,977 A * 2/1993 Horitani ..... 181/266
5,234,364 A 8/1993 Ito
5,251,439 A 10/1993 Nakase et al.
5,324,217 A 6/1994 Mineo
5,366,401 A 11/1994 Nanami et al.
5,490,474 A 2/1996 Ikeda
5,511,505 A 4/1996 Kobayashi et al.
5,531,620 A 7/1996 Ozawa et al.
5,536,189 A 7/1996 Mineo
5,550,337 A 8/1996 Tazaki et al.
5,572,943 A 11/1996 Kobayashi et al.
5,586,921 A 12/1996 Kobayashi et al.
5,586,922 A 12/1996 Kobayashi et al.
5,619,950 A 4/1997 Ikeda
5,634,422 A 6/1997 Kobayashi et al.
5,647,779 A 7/1997 Nanami
5,664,515 A 9/1997 Hattori et al.
5,699,749 A 12/1997 Yamada et al.
5,702,276 A 12/1997 Nakase et al.
5,732,685 A 3/1998 Nakamura
5,738,073 A 4/1998 Koike et al.
5,743,206 A 4/1998 Hattori
5,752,867 A 5/1998 Koyanagi
5,773,770 A * 6/1998 Jones ..... 181/239
5,797,775 A 8/1998 Ozawa et al.
5,853,308 A 12/1998 Nanami et al.
5,879,211 A 3/1999 Koyanagi
5,882,236 A 3/1999 Ozawa et al.
5,902,158 A 5/1999 Nakase et al.
5,954,553 A 9/1999 Ozawa et al.
6,019,090 A 2/2000 Ozawa
6,022,253 A 2/2000 Ozawa et al.
6,041,727 A 3/2000 Yamada et al.
6,068,528 A 5/2000 Suzuki
6,106,344 A 8/2000 Mashiko
6,109,220 A 8/2000 Nakamura
6,120,335 A 9/2000 Nakase et al.
6,152,258 A * 11/2000 Deavers et al. ..... 181/221

* cited by examiner

*Primary Examiner*—Stephen Avila
(74) *Attorney, Agent, or Firm*—Knobbe, Martens, Olson & Bear, LLP

(57) ABSTRACT

An exhaust system for a watercraft includes an improved construction of an exhaust silencer in which inlet and outlet conduits are arranged without interfering with each other. An inlet conduit is arranged to deliver the exhaust gases to the silencer. An outlet conduit is arranged to discharge the exhaust gases from the silencer. The silencer includes a main body defining a first chamber. The inlet conduit is coupled with the main body to communicate with the first chamber. The silencer further includes a side body bulging laterally outward from the main body. The side body defines a second chamber communicating with the first chamber. The outlet conduit is coupled with the side body to communicate with the second chamber.

35 Claims, 5 Drawing Sheets

EXHAUST SYSTEM FOR WATERCRAFT

PRIORITY INFORMATION

This application is based on and claims priority to Japanese Patent Application No. 2000-19276, filed Jun. 28, 2000.

BACKGROUND OF THE INVENTION

1. Field of the Invention

This invention relates generally to an exhaust system for a watercraft, and more particularly to an improved exhaust silencer for the exhaust system.

2. Description of Related Art

Personal watercrafts have become very popular in recent years. This type of watercraft is quite sporting in nature and carries one or more riders. A hull of the watercraft typically defines a rider's area above an engine compartment. An internal combustion engine powers a jet propulsion unit that propels the watercraft by discharging water rearward. The engine lies within the engine compartment in front of a tunnel which is formed on an underside of the hull. The jet propulsion unit is placed within the tunnel and includes an impeller that is driven by the engine.

The watercraft is provided with an exhaust system to route exhaust gases from the engine to a location out of the watercraft. In a typical arrangement, the exhaust system comprises exhaust conduits connected in series and the last conduit opens to the tunnel to discharge the exhaust gases thereto. One of the exhaust components forms a silencer to reduce exhaust noise. A body of the silencer typically is configured as a cylindrical shape structure. Usually, an inlet conduit is coupled with the body adjacent to a front end surface thereof, while an outlet conduit is coupled with the body toward an aft end of the silencer body. In some layouts of the personal watercraft, such an arrangement is not available or is not convenient due to surrounding device configurations or arrangements. For example, the outlet conduit must be placed in close proximity to the inlet conduit in one occasion. In this arrangement, however, another problem can arise in connection with the following special circumstances of the watercraft. That is, the outlet conduit preferably extends generally upwardly from the silencer body because outside water can be surely inhibited from entering the silencer body. In the meantime, normally, this type of watercraft includes a water cooling system to cool at least the engine with water, and the exhaust system allows the water to be delivered to the silencer body with the exhaust gases. In order to drive the water in the silencer body out, an inside end of the outlet conduit preferably is placed at the lowermost position within the silencer body. If, however, the outlet conduit must be placed adjacent to the inlet conduit, both the conduits (i.e., the conduits themselves and/or exhaust flows coming in and going out through the conduits) can interfere with each other within the silencer body.

A need therefore exists for an improved exhaust system of a watercraft that can have a construction of a silencer in which inlet and outlet conduits are arranged without interfering with each other.

SUMMARY OF THE INVENTION

In accordance with one aspect of the present invention, a watercraft comprises an internal combustion engine. An exhaust system is arranged to route exhaust gases from the engine to a location external of the watercraft. The exhaust system includes an exhaust silencer. An inlet conduit is arranged to deliver the exhaust gases to the silencer. An outlet conduit is arranged to discharge the exhaust gases from the silencer. The silencer comprises a main body defining a first chamber. The inlet conduit is coupled with the main body to communicate with the first chamber. A side body extends to a side of the main body. The side body defines a second chamber communicating with the first chamber. The outlet conduit is coupled with the side body to communicate with the second chamber.

In accordance with another aspect of the present invention, a watercraft comprises an internal combustion engine. An exhaust system is arranged to route exhaust gases from the engine to a location external from the watercraft. The exhaust system includes an exhaust silencer. An inlet conduit is arranged to deliver the exhaust gases to the silencer. An outlet conduit is arranged to discharge the exhaust gases from the silencer. The silencer comprises first and second body members coupled with one another. The first body member defines a first chamber. The second body member defines a second chamber communicating with the first chamber. The inlet conduit is connected to the first chamber. The outlet conduit is connected to the second chamber. A lowermost point of the second body member is lower than a lowermost point of the first body member.

In accordance with yet another aspect of the present invention, an exhaust silencer for an engine comprises a first outer housing containing a first internal volume and a partition dividing the internal volume into at least first and second chambers. The first chamber is defined between a first wall and the partition. An inlet conduit extends through the first wall into the first chamber. A first plane extends through the partition and a second plane extends through the first wall, generally parallel to the first plane. A second outer housing contains a second internal volume, and an outlet conduit extends through the second outer housing at a point disposed between the first and second planes.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise 5 figures.

DETAILED DESCRIPTION OF THE PREFERRED EMBODIMENT OF THE INVENTION

Figure 1:
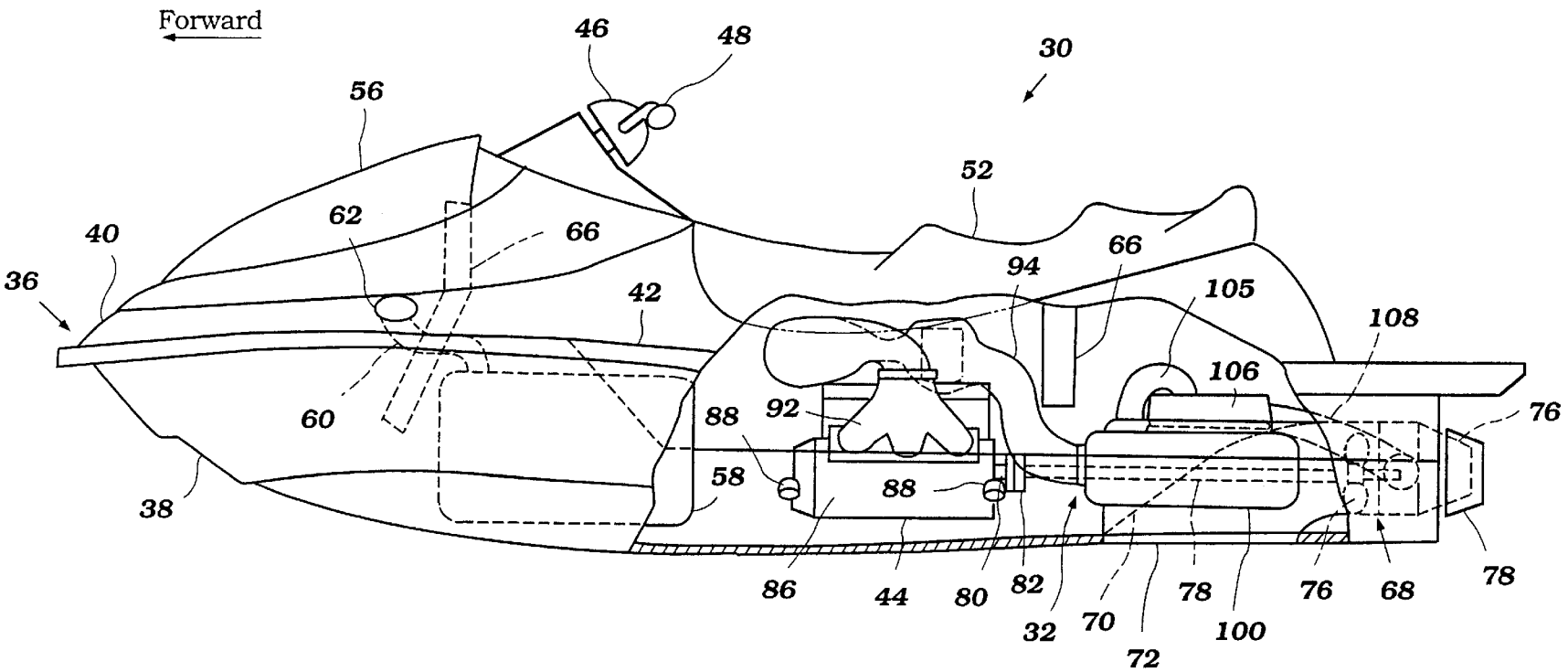
FIG. 1 is a partially sectioned, side elevational view of a personal watercraft including an exhaust system configured in accordance with a preferred embodiment of the present invention.
Figure 2:
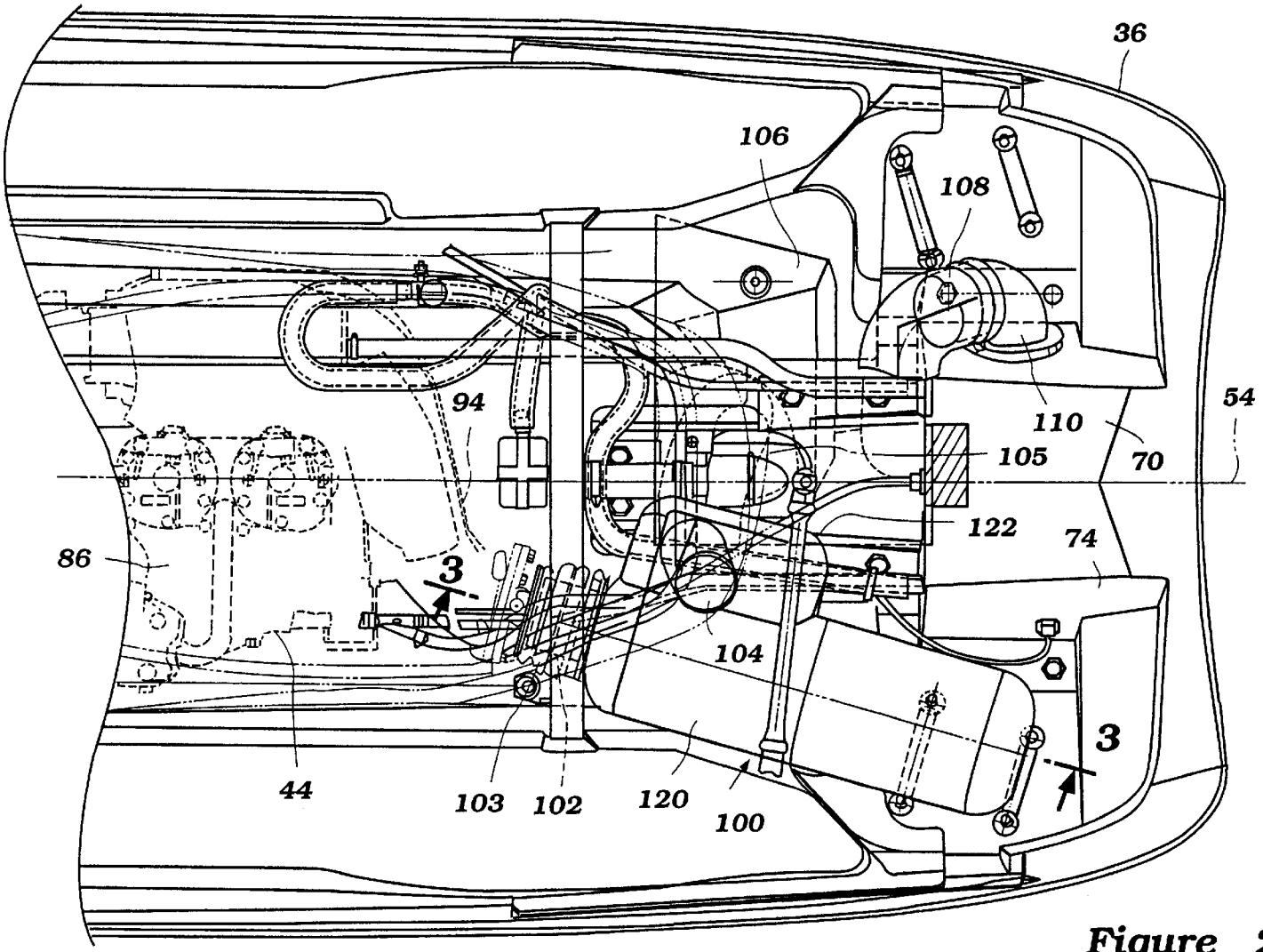
FIG. 2 is a partial top plan view of the watercraft of FIG. 1. An upper hull section of the watercraft is removed in this figure to illustrate an exhaust silencer of the exhaust system.

With reference to FIGS. 1 and 2, an overall construction of a personal watercraft 30 that employs an exhaust system 32 configured in accordance with the present invention will be described. The exhaust system has particular utility with the personal watercraft, and thus, is described in the context of the personal watercraft. The exhaust system, however, can be applied to other types of watercrafts as well, such as, for example, but without limitations, small jet boats and the like.

The personal watercraft 30 includes a hull 36 generally formed with a lower hull section 38 and an upper hull section or deck 40. The lower hull section 38 can include one or more inner liner sections to strengthen the hull 36 or to provide mounting platforms for various internal components of the watercraft 30. Both the lower and upper hull sections 38, 40 are made of, for example, a molded fiberglass reinforced resin or a sheet molding compound. The lower hull section 38 and the upper hull section 40 are coupled together to define an internal cavity. An intersection of the hull sections 38, 40 is defined in part along an outer surface gunnel or bulwark 42. The hull 30 houses an internal combustion engine 44 that powers the watercraft 30.

The lower hull section 38 is designed such that the watercraft 30 planes or rides on a minimum surface area at the aft end of the lower hull 38 in order to optimize the speed and handling of the watercraft 30 when up on plane. For this purpose, the lower hull section 38 generally has a V-shaped configuration formed by a pair of inclined sections that extend outwardly from a longitudinal center line 54 of the hull to the hull's side walls at a dead rise angle. Each inclined section desirably includes at least one strake and the strakes preferably are symmetrically disposed relative to the keel line of the watercraft 30. The inclined sections also extend longitudinally from the bow toward the transom of the lower hull 38. The side walls are generally flat and straight near the stern of the lower hull 38 and smoothly blend toward the longitudinal centerline 54 at the bow. The lines of intersection between the inclined sections and the corresponding side walls form the outer chines of the lower hull section 38.

A steering mast 46 extends generally upwardly toward the top of the upper hull section 40 to support a handlebar 48. The handlebar 48 is provided primarily for a rider to control the steering mast 46 so that a thrust direction of the watercraft 30 is properly changed. The handlebar 48 also carries control devices such as, for example, a throttle lever for operating throttle valves of the engine 44.

A seat 52 extends fore to aft along a center plane 54 (FIG. 2) of the hull 36 at a location behind the steering mast 46. The center plane 54 extends generally vertically with the watercraft resting in normal upright position. The seat 52 has generally a saddle shape so that the rider can straddle it. Foot areas are defined on both sides of the seat 52 and at the top surface of the upper hull section 40. A cushion, which has a rigid backing and is supported by a pedestal section of the upper hull section 40, forms part of the seat 52. The pedestal forms the other portion of the seat 52. The seat cushion is detachably affixed to the pedestal of the upper hull section 40. An access opening is defined on the top surface of the pedestal, under the seat cushion, through which the rider can access at least a portion of the internal cavity, i.e. an engine compartment. The engine 44 is placed in the engine compartment. The engine compartment may be an area within the internal cavity or may be divided for one or more other areas of internal cavity by one or more bulkheads.

The upper hull section 40 includes a hutch 56 that is hinged to open or is detachably affixed in front of the steering mast 46. A fuel tank 58 is placed in the internal cavity under the upper hull section 40 and preferably in front of the engine compartment. The rider can access the fuel tank 58 by opening or detaching the hatch 56. The fuel tank 58 is coupled with a fuel inlet port positioned at a top surface of the upper hull section 40 through a filler duct 60. A closure cap 62 closes the fuel inlet port. The fuel inlet port can be covered by the hatch 56 or can be disposed on the bow of the hall 36 next to the hatch 56.

Air ducts or ventilation ducts 66 are provided at appropriate locations of the upper hull section 40 so that the ambient air can enter the internal cavity through the ducts 66. Except for the air ducts, the engine compartment is substantially sealed so as to protect the engine 44, a fuel supply system (including the fuel tank) and other systems or components from water.

A jet pump assembly 68 propels the watercraft 30. The jet pump assembly 68 is mounted in a tunnel 70 formed on the underside of the lower hull section 38. Optionally, the tunnel can be isolated from the engine compartment by a bulkhead. The tunnel 70 has a downward facing inlet port 72 opening toward the body of water. A pump housing 74 (FIG. 2) is disposed within a portion of the tunnel 70 and communicates with the inlet port 72. An impeller 76 is journaled within the housing 74. An impeller shaft 78 extends forwardly from the impeller 76 and is coupled with a crankshaft or output shaft 80 of the engine 44 by a coupling unit 82 to be driven by the crankshaft 80. The rear end of the pump housing 74 defines a discharge nozzle 76. A deflector or steering nozzle 78 is affixed to the discharge nozzle 76 for pivotal movement about a steering axis extending generally vertically. A cable connects the deflector 78 with the steering mast 46 so that the rider can steer the deflector 78.

When the crankshaft 80 of the engine 44 drives the impeller shaft 78 and hence the impeller 76 rotates, water is drawn from the surrounding body of water through the inlet opening 72. The pressure generated in the pump housing 74 by the impeller 76 produces a jet of water that is discharged through the discharge nozzle 76 and the deflector 78. The water jet thus produces thrust to propel the watercraft 30.

The engine 44 in the illustrated embodiment operates on a two-cycle crankcase compression principle and has three cylinders spaced apart from one another along the center plane 54. The illustrated engine, however, merely exemplifies one type of engine in connection with which various aspects and features of the present exhaust system can be used. Other types of engines having other number of cylinders, having other cylinder arrangements, other cylinder orientations (e.g., upright cylinder banks) and operating on other combustion principles (e.g., four-cycle or rotary) can of course be applied.

The engine 44 typically includes a cylinder block defining three cylinder bores in which pistons reciprocate. At least one cylinder head member is affixed to the upper end of the cylinder block to close respective upper ends of the cylinder bores and defines combustion chambers with the cylinder bores and the pistons. A crankcase member is also affixed to the lower end of the cylinder block to close the respective lower ends of the cylinder bores and to define a crankcase chamber with the cylinder block. The crankshaft 80 is rotatably connected to the pistons through connecting rods and is journaled for rotation within the crankcase. The cylinder block, the cylinder head and the crankcase member preferably are made of aluminum alloy and together define an engine body 86.

Engine mounts 88, which are schematically shown in FIG. 1, extend from both sides of the engine body 86. The engine mounts 88 preferably include resilient portions made of, for example, rubber material. The engine body 86 is mounted on the lower hull section 38 (or possibly on the hull liner) by the engine mounts 88 so that vibration of the engine body 86 is inhibited from transferring to the hull section 38.

The engine 44 preferably includes an air induction system to induct air into the combustion chambers from within the internal cavity. Throttle valves are disposed within the induction system to regulate an amount of air delivered to the combustion chambers. The engine 44 can also include a fuel supply system including one or more charger formers, such as, for example, a carburetor system, or a direct or indirect fuel injection system. The fuel supply system supplies fuel to the combustion chambers generally in proportion to the air amount regulated by the throttle valves so that a proper air/fuel ratio can be held.

An ignition or firing system preferably is provided to ignite the air/fuel charge in the combustion chambers. The ignition system preferably includes spark plugs that have electrodes exposed into the combustion chambers, and ignition devices such as ignition coils and an igniter. The spark plugs fire the air/fuel charges in the combustion chambers by sparks made by the ignition devices at proper ignition timings controlled by an ECU (electronic control unit) or other control units.

The exhaust system 32 is provided to route burnt charges, i.e., exhaust gases, from the combustion chambers to a location outside the watercraft 30. In the illustrated embodiment one exhaust port is defined in the cylinder block for each combustion chamber. An exhaust manifold 92 preferably is coupled with the cylinder block. Three branched portions of the manifold 92 are connected to the respective exhaust ports. An exhaust conduit 94 is coupled with the downstream, common end of the exhaust manifold 92 and extend generally around and above the front end of the engine body 86. An end portion of the exhaust conduit 94 then turns generally rearward.

An exhaust silencer 100 preferably is placed at a location generally behind the engine 44 and is secured to the lower hull 38 (or possibly to a hull linear), firm added position generally above one of the inclined sections of the lower hull 38. The silencer 100 preferably is made of aluminum based alloy. As seen in FIG. 2, the silencer 100 is positioned on the port side relative to the longitudinal center plane 54. The end portion of the exhaust conduit 94 is coupled with an inlet conduit or pipe 102 of the silencer 100 via a flexible joint 103. An outlet conduit or pipe 104 of the silencer 100 extends generally upwardly from the silencer 100, and a flexible hose 105 that is coupled with the outlet conduit 104 extends toward the starboard side of the watercraft 30 beyond the longitudinal center plane 54. A major portion of a water trap or resonator 106 is placed in this half space. The flexible hose 105 is connected to the water trap 106 in the area of the starboard side. A discharge pipe 108 preferably extends from the water trap 106 to couple the water trap 106 with the tunnel 70. That is, the exhaust system 32 ends at a discharge port 110 that opens at the tunnel 70 and thus to the exterior of the watercraft 30. The discharge port 110 preferably is positioned at a location which can be out of the body of water in the event the watercraft 30 capsizes. The exhaust gases can be discharged through the exhaust manifold 92, exhaust conduit 94, flexible joint 103, inlet conduit 102 of the silencer 100, silencer 100, outlet conduit 104 of the silencer 100, flexible hose 105, water trap 106 and discharge pipe 108. Because of the arrangements of the exhaust components, the outside water cannot enter the engine 44 even if the watercraft 30 capsizes or take any positions on the body of water. The construction of the water trap 106 can be in accordance with the exhaust device indicated by the reference numeral 74 as set forth in a co-pending U.S. patent application Ser. No. 09/895,014 filed Jun. 27, 2001, titled EXHAUST SYSTEM FOR WATERCRAFT, the entire contents of which is hereby expressly incorporated by reference.

As a typical watercraft construction, the watercraft 30 preferably includes an open-loop type water cooling system. The cooling water is introduced into the system from the body of water. The cooling system preferably includes a water intake conduit that is connected to a water jacket defined in the exhaust manifold 92. The cooling water is delivered at least to water jackets formed within the engine body 86 to cool engine portions which build heat therein. Typically, the water flows through a water jacket formed around the exhaust conduit 94 and then is mixed with the exhaust gases at an appropriate downstream location and is delivered to the silencer 100.

Figure 3:
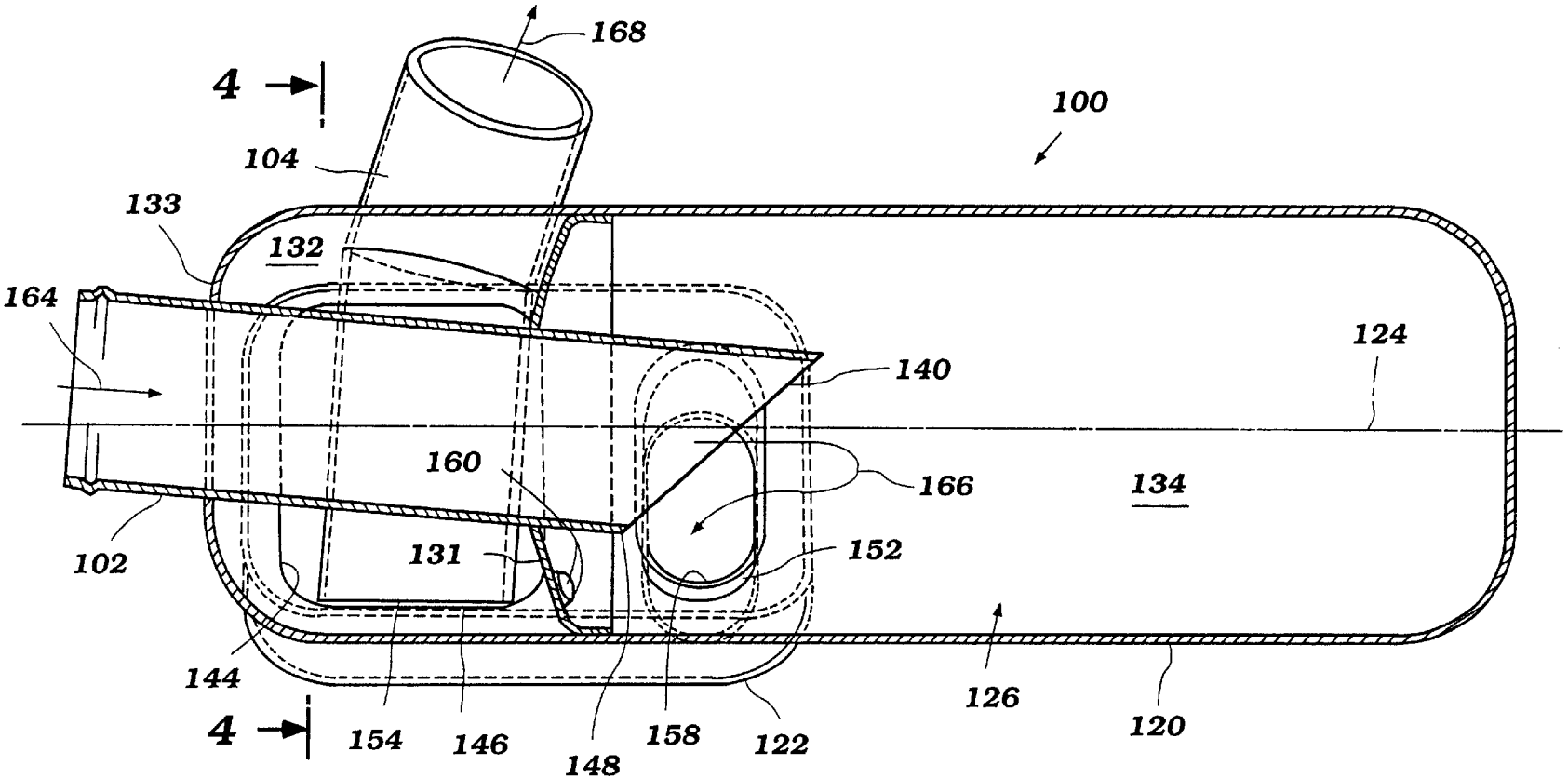
FIG. 3 is a sectional side view of the exhaust silencer of FIG. 2 taken along the line 3—3.
Figure 4:
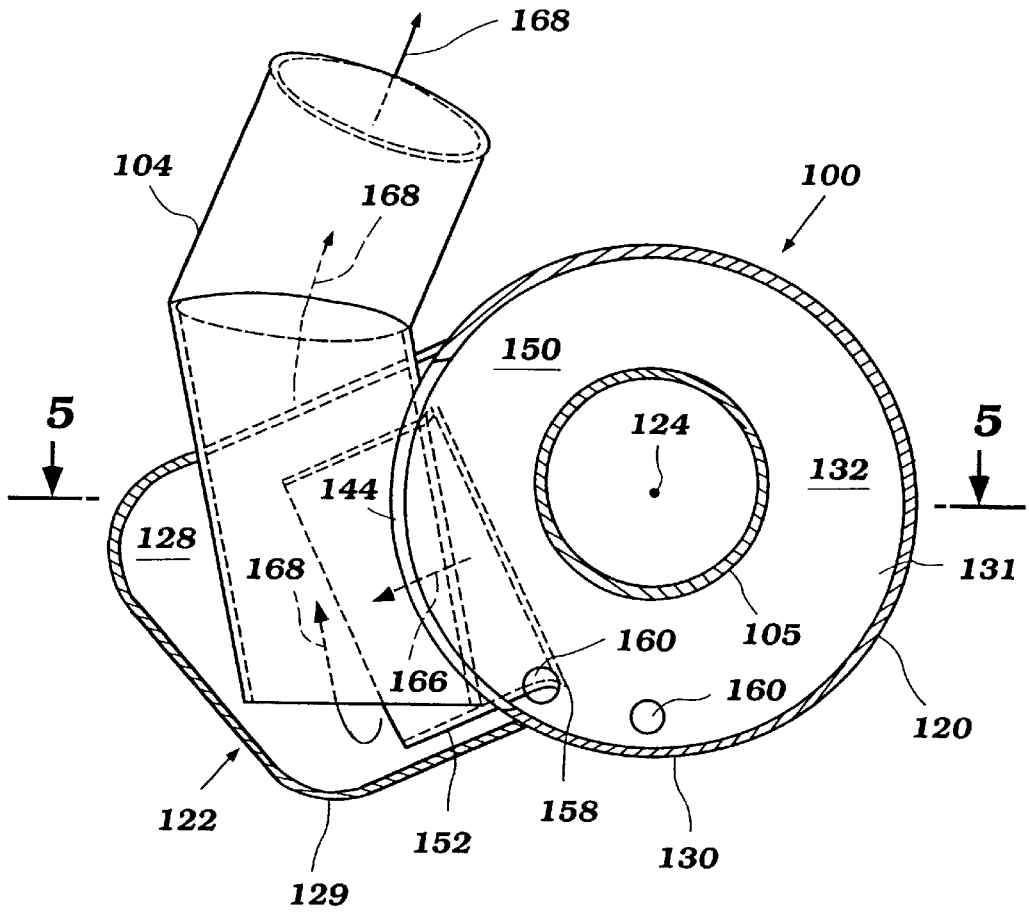
FIG. 4 is a sectional view of the exhaust silencer taken along the line 4—4 of FIG. 3.
Figure 5:
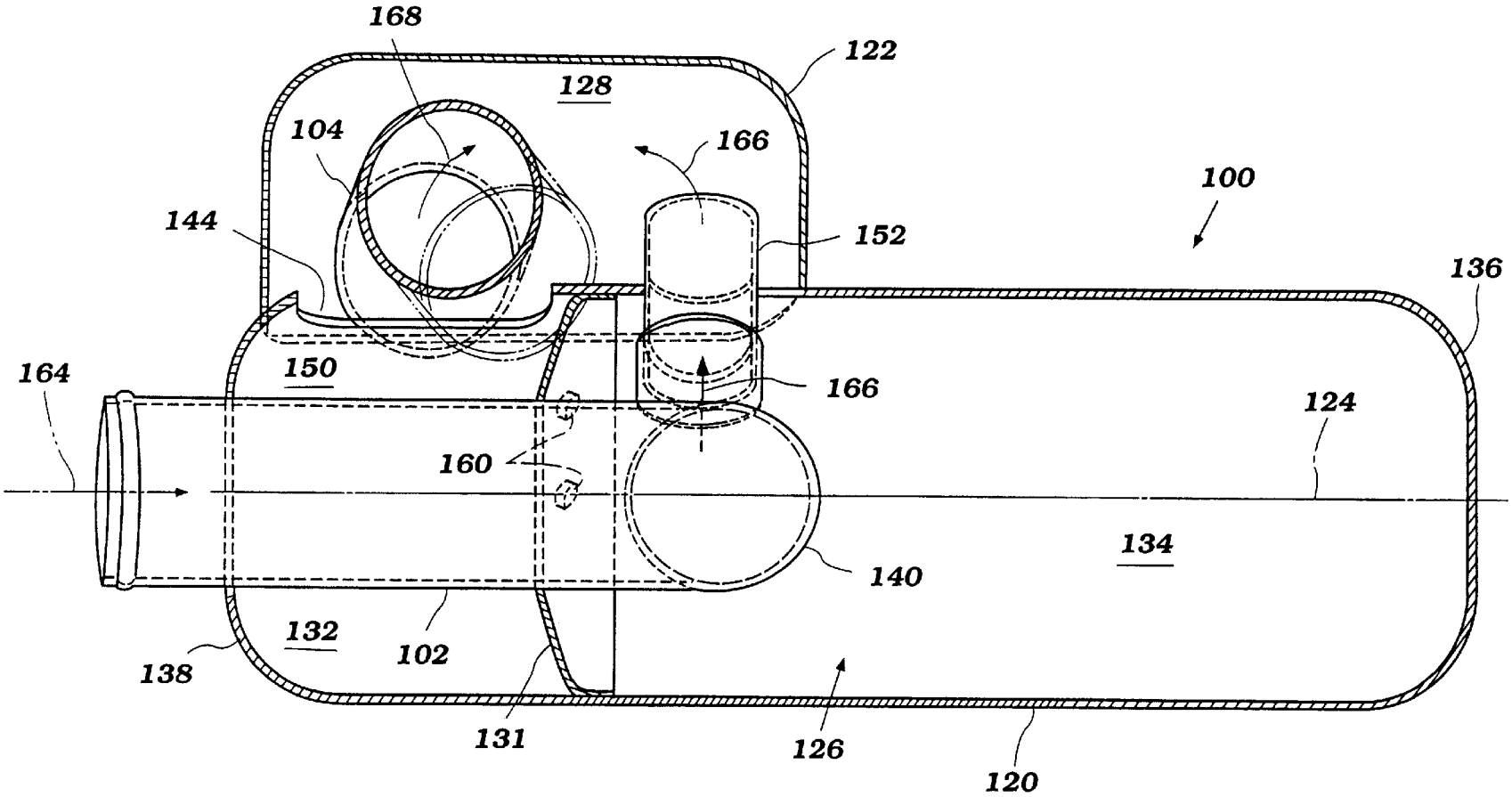
FIG. 5 is a sectional view of the exhaust silencer taken along the line 5—5 of FIG. 4.

With primary reference to FIGS. 3–5 and additionally with reference still to FIGS. 1 and 2, the exhaust silencer 100 will now be described in greater detail.

The exhaust silencer 100 preferably comprises a main body 120 and a side body 122. The main body 120 is generally configured as a cylindrical shape that has a longitudinal axis 124 and defines a chamber 126 therein. The longitudinal axis 124 extends to part from the longitudinal center plane 54 rearwardly so as to avoid interference with the pump housing 74. The side body 122 in turn is generally configured as a rectangular parallelepiped to define another chamber 128 therein. The side body 122 preferably is formed separately from the main body 120 and is welded to a side surface of the main body 120 on its starboard side. That is, the side body 122 bulges out laterally from the main body 120. As best seen in FIG. 4, the side body 122 slants outwardly downwardly so that a bottom 129 thereof is positioned lower than a bottom 130 of the main body 120. Thus, the lowermost point of the side body 122 (defined by the bottom 129) is an elevation lower than the lowermost point of the main body 120 (defined by the bottom 130). With this arrangement, the lowermost points of the main body 120 and the side body 122 generally follow the slope of the inclined section of the lower hull 38. The side surface where the side body 122 is welded to the main body 120 is located in a forward-most area of the main body 120.

A partition 131 is welded inside the main body 120 to extend transversely, i.e., normal to the longitudinal axis 124, between both internal surfaces. The partition 131 thus divides the chamber 126 to define a forward sub-chamber 132 and a rear sub-chamber 134. The forward sub-chamber 132 is thus defined, in part, by a forward wall 133 of the main body 120 and the partition 131. The location where the partition 131 is welded corresponds to a portion of the main body 120 which is within the forward area.

While a rear end 136 of the main body 120 is completely closed, a forward end 138 thereof defines an opening which center is almost on the longitudinal axis 124. The partition 131 also defines an opening which center also is almost on the same axis 124. Respective inner diameters of the openings are generally equal to each other and also to an outer diameter of the inlet conduit 102. The inlet conduit 102 thus is fitted into both the openings to dispose a rear end 140 of the inlet conduit 102 within the rear sub-chamber 140, and is welded with both the forward end 138 and the partition 131 to close up the openings. That is, the inlet conduit 102 penetrates through the forward sub-chamber 132 to reach the rear sub-chamber 134. As best seen in FIG. 3, the inlet conduit 102 slants downwardly rearwardly. As best seen in FIG. 4, a center axis of the inlet conduit 102 is almost inconsistent with the longitudinal axis 124 of the main body 120, although slanting. The rear end 140 of the inlet conduit 102 is cut so that the exhaust gases are directed generally downwardly when entering the rear sub-chamber 134.

The side surface of the main body 120 where the side body 122 is positioned preferably defines an opening 144 between the forward end 138 and the partition 131. The opening 144 preferably generally configured as a square shape. The chamber 128 of the side body 122 thus communicates with the forward sub-chamber 132 of the main body 120. A lower end 146 of the opening 144 is positioned lower than a most-lower end 148 of the inlet conduit 102. As the silencer construction, the chamber 128 and the forward sub-chamber 132 together define an expansion chamber 150, while the rear sub-chamber 134 solely defines another expansion chamber. Both the expansion chambers 134, 150 have certain volumes so that the exhaust gases expand to reduce exhaust energy therein.

The same side surface of the main body 120 also defines an opening slightly rearward the partition 130 but at a portion existing within the chamber 128 of the side body 122. A connecting pipe 152 is fitted into the opening to connect the chamber 128 with the rear sub-chamber 134. The connecting pipe 152 is welded with the side surface of the main body 100. As best seen in FIG. 4, the connecting pipe 152 slants outwardly downwardly along the configuration of the side body 122. The rear end 140 of the inlet conduit 102 is positioned adjacent to the opening, i.e., the connecting pipe 152. It should be noted that the connecting pipe 152 is not necessarily provided. However, the pipe 152 advantageously orients the exhaust gas flow generally downwardly.

The side body 122 defines an opening atop thereof. The outlet conduit 104 extends through the opening and is welded to the side body 122. The outlet conduit 104 preferably is disposed closer to the opening 21 rather than the connecting pipe 152. A lower end 154 of the outlet conduit 104 preferably is positioned lower than the lower-most end 148 of the inlet conduit 102 and is generally positioned at the same level as the lower-most end 146 of the opening 144. As noted, the outlet conduit 104 extends generally upwardly. More specifically, with the upward extension, the outlet conduit 104 slightly bends rearwardly as seen in FIG. 3 and also slightly protrudes outwardly as seen in FIG. 4.

Arranged as such, the first sub-chamber 132, the point at which the inlet conduit 102 passes through the wall 133, and the outlet conduit 104 extend along a portion of the exhaust silencer having a length equal to approximately one-third of the total length of the exhaust silencer 100. Thus, the inlet end of the inlet conduit 102 and the outlet end of the outlet conduit 104 can be disposed in the forward-most one-third portion of the silencer 100 and thus, more conveniently connected to other exhaust components while the rearward most end of the silencer 100 can the positioned in a more remote portion of the engine compartment.

The water coming from the exhaust conduit 94 flows into the chamber 126, specifically, the rear sub-chamber 134. The water can flow out to the chamber 128 of the side body 122 through the connecting pipe 152. Due to the slant arrangement of the connecting pipe 152, a lower end 158 of the pipe 152 located at the rear sub-chamber 134 is higher than a bottom end of the sub-chamber 134. The water thus can accumulate within the rear sub-chamber 134. The partition 131 preferably defines one or more water drains 160 that can expedite draining of the accumulated water to the chamber 128 through the forward sub-chamber 132. The drains 160 preferably are positioned lower than the lower end 158, which is located at the rear sub-chamber 134, of the connecting pipe 152, or at least at the same level as the end 160.

The exhaust conduit 94 sends the exhaust gases to the inlet conduit 102 through the flexible joint 103. The exhaust gases flow through the inlet conduit 102 as indicated by the arrows 164 of FIGS. 3 and 5, and enter the rear sub-chamber 134. Because the sub-chamber 134 is the expansion chamber, the exhaust gases expand therein to lose exhaust energy. The exhaust gases then go to the chamber 128 of the side body 122 through the connecting pipe 152 as indicated by the arrows 166 of FIGS. 3–5. Since the chamber 128 communicates with the forward sub-chamber 132 of the main body 120 to define the expansion chamber 150, the exhaust gases again expand in this expansion chamber 150 to lose the energy further. The exhaust gases then flow through the outlet conduit 104 and go to the water trap 106 via the flexible hose 105 as indicated by the arrows 168 of FIGS. 3–5. In the illustrated embodiment, because the exhaust gases expand twice, the exhaust noise can be extremely reduced. It should be noted, however, only one expansion chamber is practicable in some occasions.

Simultaneously, the water coming from the exhaust conduit 94 is pushed out to the water trap 106 by the exhaust pressure. Although the water of course is heavier than the exhaust gases, the exhaust pressure is sufficient enough to pressurize and drive the water to go out. The downward slant of the connecting pipe 152 can assist urging of the water by the exhaust pressure. In addition, because the bottom end 129 of the side body 122 is positioned lower than the bottom end 130 of the main body 120, the water can be collected in the bottom of the side body 122. The outlet conduit 104 opens closely to the water collection. The water thus is vigorously wiped out toward the outlet conduit 104. The lower bottom 129 of the side body can also advantageously lower the water level within the silencer 100 than the lower-most end 148 of the inlet conduit 102 so that the water hardly returns back to the engine 44.

As thus described, the inlet and outlet conduits of the illustrated embodiment can be arranged in the silencer construction without interfering with each other even though they are closely disposed with each other.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein the outlet conduit extends generally upwardly through an upper section of the side body.

2. The watercraft as set forth in claim 1, wherein the first chamber is divided into a first sub-chamber and a second sub-chamber, the inlet conduit being connected to the second sub-chamber.

3. The watercraft as set forth in claim 2, wherein the first and second sub-chambers communicate with each other through the second chamber.

4. The watercraft as set forth in claim 3, wherein the second sub-chamber is connected to the second chamber through an opening, the opening being formed adjacent to an outlet end of the inlet conduit disposed within the second sub-chamber.

5. The watercraft as set forth in claim 4, wherein the opening comprises a connecting conduit extending transversely to the inlet conduit.

6. The watercraft as set forth in claim 3, wherein the first sub-chamber is connected to the second chamber through an opening, and the opening is formed adjacent to the outlet conduit.

7. The watercraft as set forth in claim 1 additionally comprising a water cooling system arranged to cool at least a portion of the exhaust system with water, wherein the exhaust system allows the water at least in part to be delivered to the silencer with the exhaust gases.

8. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein the first chamber is divided into a first sub-chamber and a second sub-chamber, the inlet conduit being connected to the second sub-chamber, the first and second sub-chambers communicating with each other through the second chamber, the second sub-chamber being connected to the second chamber through an opening, the opening being formed adjacent to an outlet end of the inlet conduit disposed within the second sub-chamber, and wherein the outlet end of the inlet conduit faces downwardly.

9. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein the first chamber is divided into a first sub-chamber and a second sub-chamber, the inlet conduit being connected to the second sub-chamber, the first and second sub-chambers communicating with each other through the second chamber, the second sub-chamber being connected to the second chamber through an opening, the opening being formed adjacent to an outlet end of the inlet conduit disposed within the second sub-chamber, and a partition disposed between the first and second sub-chambers, the partition including a water drain positioned lower than an inlet end of the opening.

10. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein the first chamber is divided into a first sub-chamber and a second sub-chamber, the inlet conduit being connected to the second sub-chamber, and wherein the inlet conduit extends through the first sub-chamber to communicate with the second sub-chamber.

11. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein an outlet end of the inlet conduit disposed within the main body is configured so that the exhaust gases are directed generally downwardly when entering the first chamber.

12. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein a bottom of the side body is positioned lower than a bottom of the main body.

13. The watercraft as set forth in claim 12, wherein an end of the outlet conduit disposed within the side chamber is positioned lower than an end of the inlet conduit disposed within the main body.

14. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein an end of the outlet conduit disposed within the side chamber is positioned lower than an end of the inlet conduit disposed within the main body.

15. The watercraft as set forth in claim 14, wherein the outlet conduit extends generally upwardly through an upper surface of the side body.

16. The watercraft as set forth in claim 14 additionally comprising a water cooling system arranged to cool at least a portion of the exhaust system with water, the water cooling system communicating with the exhaust system such that at least a portion of the water is introduced into the exhaust gas flow upstream of the exhaust silencer.

17. A watercraft comprising an internal combustion engine, and an exhaust system arranged to route exhaust gases from the engine to an external location, the exhaust system including an exhaust silencer, an inlet conduit arranged to deliver the exhaust gases to the silencer, and an outlet conduit arranged to discharge the exhaust gases from the silencer, the silencer comprising a main body defining a first chamber, the inlet conduit being coupled with the main body to communicate with the first chamber, and a side body extending outwardly toward a side of the main body, the side body defining a second chamber communicating with the first chamber, and the outlet conduit being coupled with the side body to communicate with the second chamber, wherein the main body generally has a cylindrical shape.

18. The watercraft as set forth in claim 17, wherein the main body includes a partition transversely disposed therein to divide the first chamber into two sub-chambers.

19. The watercraft as set forth in claim 18, wherein the inlet conduit extends through the partition to communicate with one of the sub-chambers.

20. A watercraft comprising an internal combustion engine, and an exhaust system arranged to route exhaust gases from the engine to an exterior of the watercraft, the exhaust system including an exhaust silencer, an inlet conduit arranged to deliver the exhaust gases to the silencer, and an outlet conduit arranged to discharge the exhaust gases from the silencer, the silencer comprising first and second body members coupled with each other, the first body member defining a first chamber and a second chamber positioned generally rearward from the first chamber, the first body member defining a first lowermost point, the second body member defining a third chamber disposed at least partially on a lateral side of the first chamber and at least partially forward from the second chamber, the second body member including a second lowermost point disposed lower than the first lowermost point.

21. The watercraft as set forth in claim 20 additionally comprising a water cooling system arranged to cool at least a portion of the exhaust system, wherein the exhaust system allows at least a portion of the water to be delivered to the silencer with exhaust gases flowing therein.

22. The watercraft as set forth in claim 20, wherein the first chamber is defined between a forward wall of the first body member and a partition which is between the first and second chambers, the inlet conduit extending through the forward wall, the forward wall defining a first plane and the partition defining a second plane, the outlet conduit being positioned between the first and second planes.

23. The watercraft as set forth in claim 20, wherein the outlet conduit extends generally upwardly through an upper section of the second body member.

24. The watercraft as set forth in claim 20 additionally comprising a partition between the first and second chambers, the partition including at least one water drain through which the first and second chambers communicate with each other.

25. The watercraft as set forth in claim 24, wherein one of the first and second chambers communicates with the third chamber through an opening, the drain being positioned lower than a lower end of the opening.

26. The watercraft as set forth in claim 20 additionally comprising a hull defining a keel line and having a lower portion comprising two inclined sections extending from the keel line at a dead rise angle.

27. The watercraft according to claim 26, wherein the exhaust silencer is disposed above at least one of the two inclined sections.

28. The watercraft according to claim 27, wherein the first and second lowermost points are arranged generally to follow a slope of the at least one of the two inclined sections.

29. An exhaust silencer for an engine comprising a first outer housing section containing a first internal volume, a partition dividing the internal volume into at least first and second chambers, the first chamber being defined between a first wall and the partition, an inlet conduit extending through the first wall into the first chamber, a first plane extending through the partition, a second plane extending through the first wall and generally parallel to the first plane, a second outer housing section containing a second internal volume, and an outlet conduit extending through the second outer housing section at a point disposed between the first and second planes, wherein the first and second chambers are arranged generally longitudinally in the first outer housing, and wherein the inlet conduit, a longitudinal end wall of the outer housing, and the outlet conduit extend along a portion of the silencer having a length equal to one-third of a total length of the exhaust silencer.

30. An exhaust silencer for an engine comprising a first outer housing section containing a first internal volume, a partition dividing the internal volume into at least first and second chambers, the first chamber being defined between a first wall and the partition, an inlet conduit extending through the first wall into the first chamber, a first plane extending through the partition, a second plane extending through the first wall and generally parallel to the first plane, a second outer housing section containing a second internal volume, and an outlet conduit extending through the second outer housing section at a point disposed between the first and second planes, wherein the first outer housing has a substantially cylindrical shape.

31. The exhaust silencer as set forth in claim 30, wherein the first and second chambers are arranged generally longitudinally in the first outer housing.

32. The exhaust silencer as set forth in claim 30, wherein the first wall comprises a longitudinal end wall of the outer housing.

33. The exhaust silencer as set forth in claim 30, wherein the first wall comprises curved portions.

34. The exhaust silencer as set forth in claim 30, wherein the second outer housing includes a peripheral edge that is joined to an outer surface of the first outer housing, the first outer housing cooperating with the second outer housing, in part, to define the second internal volume.

35. An exhaust silencer for an engine comprising a first outer housing section containing a first internal volume, a partition dividing the internal volume into at least first and second chambers, the first chamber being defined between a first wall and the partition, an inlet conduit extending through the first wall into the first chamber, a first plane extending through the partition, a second plane extending through the first wall and generally parallel to the first plane, a second outer housing section containing a second internal volume, and an outlet conduit extending through the second outer housing section at a point disposed between the first and second planes, wherein the partition is bowl-shaped.

* * * * *